United States Patent [19]

Hansen et al.

[11] Patent Number: 4,836,175

[45] Date of Patent: Jun. 6, 1989

[54] IGNITION SYSTEM DWELL CONTROL

[75] Inventors: Mark C. Hansen, Kokomo; Walter K. Kosiak, Lafayette, both of Ind.

[73] Assignee: Delco Electronics Corporation, Kokomo, Ind.

[21] Appl. No.: 226,711

[22] Filed: Aug. 1, 1988

[51] Int. Cl.[4] ..... F02P 3/045

[52] U.S. Cl. ..... 123/609; 123/644

[58] Field of Search ..... 123/609, 644, 611

[56] References Cited

U.S. PATENT DOCUMENTS

| | | | |
|---|---|---|---|
| 4,018,202 | 4/1977 | Gartner | 123/609 |
| 4,248,195 | 2/1981 | Gorille | 123/609 |
| 4,359,036 | 11/1982 | Seeger et al. | 123/609 |
| 4,378,778 | 4/1983 | Harter | 123/609 |
| 4,711,226 | 12/1987 | Neuhalfen et al. | 123/609 |
| 4,750,467 | 6/1988 | Neuhalfen | 123/644 |

FOREIGN PATENT DOCUMENTS

| | | | |
|---|---|---|---|
| 56-151264 | 11/1981 | Japan | 123/644 |

*Primary Examiner*—Andrew M. Dolinar
*Attorney, Agent, or Firm*—C. R. Meland

[57] ABSTRACT

A control circuit for developing a digital signal for use in a closed loop dwell control of an electronic internal combustion engine ignition system. The circuit has a ramp counter and a down-counter. The ramp counter counts-up clock pulses for a period of time beginning when the primary winding of an ignition coil is energized and ending when primary winding current increases to a sensed current limit value. When current limit is reached, the most significant bits of the count in the ramp counter are loaded into the down-counter. The ramp counter is now counted-up and the down-counter is counted-down until the down-counter underflows. The final or ultimate count magnitude in the ramp counter is equal to the count attained by the ramp counter between energization of the primary winding and attainment of current limit added to a fixed percentage of the count attained by the ramp counter.

6 Claims, 1 Drawing Sheet

IGNITION SYSTEM DWELL CONTROL

Figures 1, 2:
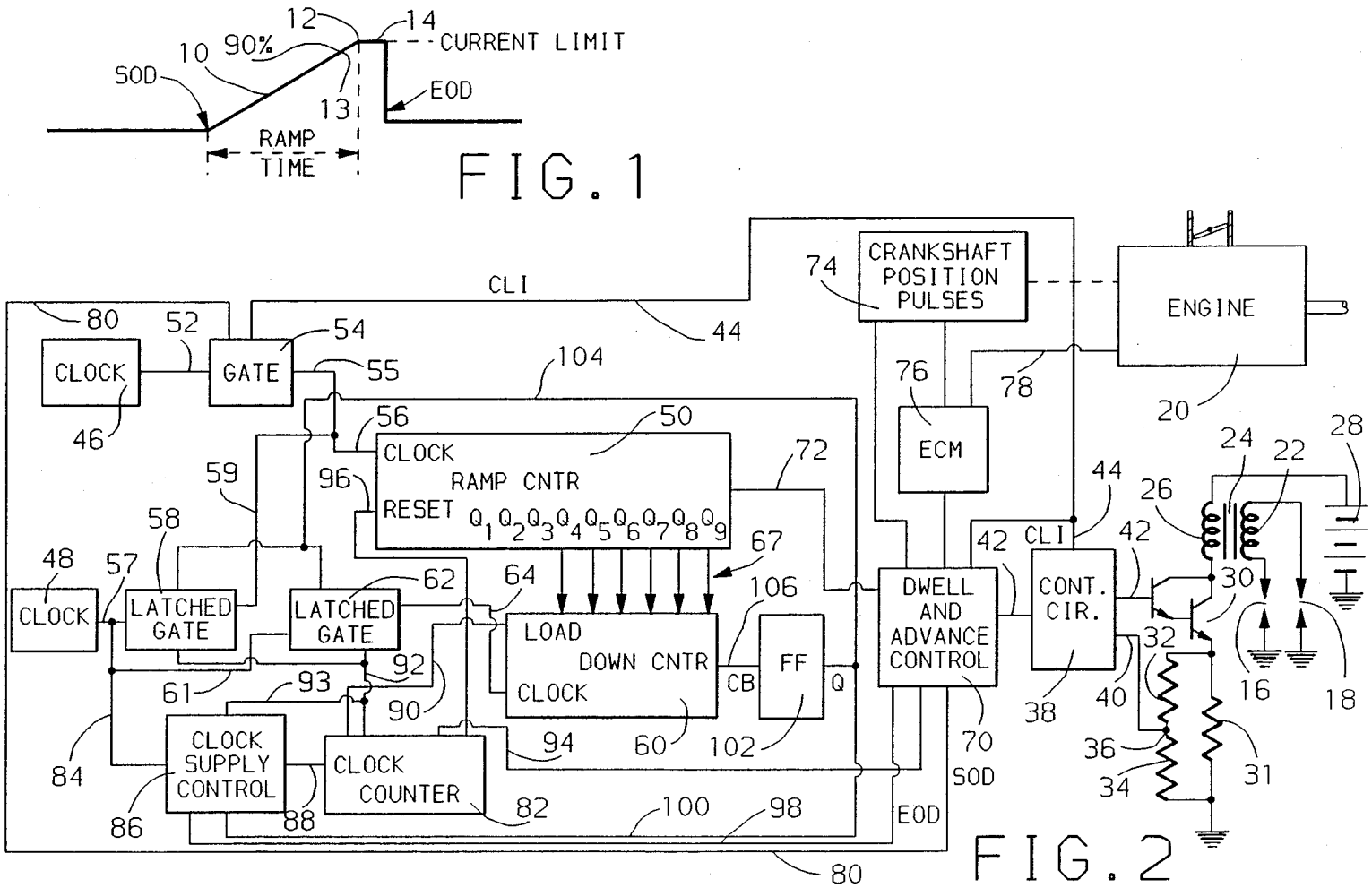

This invention relates to a dwell control system for an electronic internal combustion engine ignition system and more particularly to a control circuit for developing a compensated digital signal that is a function of a time period beginning with energization of the primary winding of an ignition coil and ending when primary winding current increases to a current limit value.

The U.S. Pat. No. 4,711,226 to Neuhalfen et al discloses a dwell control system wherein the ramp or rise time of the primary winding current of an ignition coil is determined where the ramp time is a time period beginning with energization of the primary winding of an ignition coil and ending when primary winding current increases to a current limit value. This is accomplished by counting clock pulses in a ramp counter where the counting begins when the primary winding is energized and where counting terminates when primary winding current increases to a sensed current limit value. When primary winding current increases to a sensed current limit value, a current limit signal is developed and a transistor that controls primary winding current is biased into a current limiting mode. The transfer function of the current sensing amplifier of the patent is non-ideal so that it may develop a current limit signal at less primary winding current than a desired or specified current limit value. By way of example, the current limit signal may be developed when primary current increases to 90% of the desired current limit value. In order to compensate for this inherent error mechanism, the closed loop dwell circuitry of the Neuhalfen et al patent uses preset values, which are added to the ramp time, to model the 10% inaccuracy. The preset value is determined from the ignition coil's previous ramp time. This preset value is loaded into the ramp counter before the present start of dwell (SOD) occurs. Once dwell begins, the ramp counter containing the preset, begins counting. When a current limit signal occurs, counting by the ramp counter ceases. Thus, the ramp counter contains all of the ramp time before the current limit signal occurs, plus a fixed number to compensate for the error.

The system of the Neuhalfen et al patent has a limited number of fixed presets for the full range of coil ramp times and accordingly these presets do not accurately represent the continuous 10% dwell inaccuracy. The more ramp time decodes, and hence fixed presets, the more accurate the model. However, the greater the number of decodes, the larger the programmable logic array (PLA) used in the Neuhalfen et al patent becomes in order to process the decodes and choose the correct preset. This consumes large amounts of silicon area. Further, the PLA will never be completely accurate unless a separate decode and preset are available for every possible ramp time.

In the Neuhalfen et al patent, the system divides the ramp time into only three ranges. Even this small set of ranges requires a large PLA and switching circuitry that could total as high as 700 transistors.

The present invention eliminates the PLA used in the Neuhalfen et al patent. Instead of using a PLA, the present invention uses a ramp counter of the type disclosed in the Neuhalfen et al patent that cooperates in a unique manner with a down-counter. The ramp counter is an up counter and it counts constant frequency clock pulses for a period of time beginning when the primary winding of an ignition coil is energized or start of dwell (SOD), and ending when a current sensing amplifier develops a signal indicative of the fact that primary current has increased to a sensed current limit value. The count in the ramp counter represents ramp time. When the current limit signal is developed, the most significant bits of the ramp counter are loaded into the down-counter. The ramp counter is now incremented or counted-up and the down-counter is now decremented or counted-down at a constant frequency. This continues until the down-counter underflows whereupon the up-counting of the ramp counter and the down-counting of the down-counter is terminated. The net effect of this is that the ultimate or final count in the ramp counter will be equal to the count attained by the ramp counter. between SOD and sensed current limit added to a fixed or constant percentage of the attained count. Since the count in the ramp counter represents elapsed time, the final count in the ramp counter represents ramp time added to a fixed percentage of the ramp time. It will be appreciated that the system of this invention will respond to the entire ramp time range.

It accordingly is an object of this invention to provide a new and improved control circuit for developing a compensated digital signal that is related to ramp time wherein a ramp counter is incremented for a period of time beginning when the primary winding of an ignition coil is energized and ending when current limit is reached and wherein the count attained by the ramp counter during this period of time is processed to provide a digital signal that equals the count attained by the ramp counter added to a fixed percentage of the count attained by the ramp counter.

Another object of this invention is to provide a system of the type described wherein the processing of the count attained by the ramp count is accomplished by the use of a down-counter and wherein the most significant bits of the count attained in the ramp counter is loaded into the down-counter and wherein the ramp counter is then counted-up and the down-counter counted down until the down-counter underflows. The final or ultimate count in the ramp counter has a count magnitude that is equal to attained count added to a fixed percentage of the attained count.

IN THE DRAWINGS

FIG. 1 illustrates a current waveform where the primary widing current of an ignition coil is plotted against elapsed time; and FIG. 2 illustrates a control circuit made in accordance with this invention.

Referring now to the drawings, FIG. 1 illustrates a waveform of the primary winding current of an ignition coil plotted against elapsed time. In FIG. 1, the primary winding of an ignition coil is energized at the start of dwell (SOD) by biasing a switching transistor conductive. The primary current now increases and ramps up along ramp curve or line 10. When primary winding current reaches a predetermined desired current limit value at point 12, the switching transistor that controls primary winding current is biased into a current limit mode. When this happens, primary winding current is held at a substantially constant value depicted by line 14. The time required for primary winding current to attain the current limit value is the ramp time and it is depicted in FIG. 1 for the case where current has attained the desired current limit value. Also depicted in FIG. 1 is a current level which is identified as 90% of the current limit value. This occurs at a point identified by reference numeral 13. At the end of dwell point EOD the transistor that controls primary winding current is biased nonconductive to cause spark plug firing from the secondary of the ignition coil.

The optimum spark event occurs when EOD occurs just after current limit is reached, that is, the transistor that controls primary winding current should be biased nonconductive immediately after point 12 of the waveform of FIG. 1. This allows the ignition coil to generate enough energy to cause the spark plug to fire, without excessive power dissipation which could be caused by operation for too long a time period in the current limit mode along line 14.

In describing the dwell control of this invention which is illustrated in FIG. 2, references will be made to the system disclosed in the above mentioned U.S. Pat. No. 4,711,226 to Neuhalfen et al and the disclosure of that patent is incorporated herein by reference.

Referring now to FIG. 2, the reference numerals 16 and 18 designate spark plugs for a spark ignited internal combustion engine 20. These spark plugs are connected to the secondary winding 22 of an ignition coil 24. The primary winding 26 of the ignition coil is connected between a source of direct voltage 28 and Darlington switching transistor 30. Darlington transistor 30 is connected in series with a current sensing resistor 31. Voltage divider resistors 32 and 34 having a node or junction 36 are connected across resistor 31. When resistor 30 is biased conductive primary winding current flows through primary winding 26, through transistor 30 and then through current sensing resistor 31 to ground. The voltage that is developed at junction 36 is a function of primary winding current magnitude and this voltage follows the waveform shown in FIG. 1. The voltage at junction 36 is applied to a control circuit 38 via line 40. The control circuit 38 is further connected to the base of transistor 30 by line 42 and to a line 44. A current limit signal CLI is developed on line 44 whenever primary winding current attains a current limit value. The control circuit 38 applies a square wave signal to line 42 which causes transistor 30 to be biased either conductive or nonconductive. The control 38 takes the form shown in FIG. 3 of the above-referenced Neuhalfen et al patent.

When an SOD signal transition is applied to line 42 transistor 30 is biased to a conductive saturated condition. Primary current now increases along ramp line 10. When primary winding current reaches a current limit value, the voltage developed at junction 36 causes transistor 30 to be brought out of saturation and to come biased into a current limiting mode (line 14 of FIG. 1). When it is desired to fire spark plugs 16 and 18, a signal transition occurs on line 42 which biases transistor 30 nonconductvie. When transistor 30 goes nonconductive, a voltage is developed in secondary winding 22 to cause plugs 16 and 18 to be fired.

The system of FIG. 2 has two clock pulse sources designated respectively as 46 and 48. The clock 46 develops square wave clock pulses at a constant frequency of about 10 Khz where engine 20 is a four cylinder engine. If engine 20 were a six cylinder engine, the frequency of clock 46 would be about 16 Khz. The clock 48 also develops square wave clock pulses at a constant frequency that is higher than the frequency of clock 46. Thus, the frequency of clock 48 may be about 125 Khz.

The clock 46 is connected to the clock input of a ramp counter 50 via line 52, gate 54, line 55 and line 56. The counter 50 is an up-counter. As will be more fully described hereinafter gate 54, is actuated to a closed condition wherein it connects clock 46 to the clock input of counter 50 at SOD or in other words at the time transistor 30 is biased conductive. Gate 54 is actuated to an open condition by a signal developed on line 44 to terminate the application of clock pulses to counter 50 when primary winding current increases to a current limit value to thereby cause transistor 30 to be biased into a current limit mode.

The clock 48 is connected to the clock input of up-counter 50 via line 57, latched gate 58, line 59 and line 56. The clock 48 is also connected to the clock input of a down counter 60 via line 57, line 61, latched gate 62 and line 64. As will be more fully described hereinafter, the gates 58 and 62 are at times actuated to a closed condition to connect clock 48 to counters 50 and 60.

The counter 50 is a nine-bit up-counter and the counter 60 is a six-bit down-counter. As will be more fully described hereinafter, the six most significant bits of counter 50 are periodically loaded into down-counter 60 via the six bit lines 67 that are connected to bit output terminals Q4-Q9 of counter 50. The counters 50 and 60 are so-called ripple counters and are comprised of a plurality of flip-flops.

The digital count value in counter 50 can be applied to a dwell and advance control circuit 70 via line 72. The control circuit 70 has an anti-dwell counter and various other elements disclosed in the above-referenced Neuhalfen et al patent. The control 70 may include latches in a manner described in the Neuhalfen et al patent for receiving and storing the count attained by counter 50.

The crankshaft of engine 20 is connected to apparatus designated as 74 for developing crankshaft position pulses. These crankshaft position pulses are applied to control 70 and to an electronic control module 76 that supplies spark timing information to control 70. The ECM 76 is connected to sense various engine parameters via line 78, such as engine temperature and engine manifold pressure and other factors well known to those skilled in the art.

The control 70 develops an SOD signal that is applied to line 80 whenever transistor 30 is biased conductive or in other words at start of dwell. The manner in which this signal is developed is described in the Neuhalfen et al patent. The line 80 is connected to gate 54. When an SOD signal is applied to line 80, it causes gate 54 to be actuated to a closed conductive state so that clock pulses from clock 46 are now applied to the clock input of counter 50 to cause the counter 50 to count-up.

As previously mentioned, a current limit signal CLI is developed on line 44 whenever primary winding current attains a current limit value. The line 44 is connected as an input to control 70.

The system of FIG. 2 has a clock pulse counter 82 which is connected to clock 48 via line 84, a clock supply control 86 and line 88. The counter is connected to four output or bit lines 90, 92, 94 and 96. As counter 82 is counted up by clock pulse, signals are sequentially developed on lines 90–96 in accordance with the count attained by the counter. The line 90 is connected to the load terminal of down-counter 60. The line 92 is connected to the gates 58 and 62 and to control 86 via line 93. The line 94 is connected to control 70 and the line 96 is connected to the reset terminal of counter 50.

The control 86 enables or disables the supply of clock pulses to counter 82 from clock 48. Control 86 is connected to control 70 by a line 98. An end of dwell or EOD signal is developed on line 98 when control 70 develops a signal to cause transistor 30 to be biased nonconductive to in turn cause the spark plugs to be fired. The control 86 is also connected to a control line 100. The line 100 is connected to the Q output of a flip-flop 102. This output of flip-flop 102 is also connected to gates 58 and 62 via line 104. The CB input of flip-flop 102 is connected to down-counter 60 by line 106.

The operation of the system shown in FIG. 2 will now be described. When an SOD signal is developed on line 80, gate 54 is actuated to a condition wherein clock pulses are supplied to clock 50 and it counts up. Current is now supplied to primary 26 and current increases along line 10 of FIG. 1. When primary winding current increases to a current limit value, a current limit signal CLI signal is developed on line 44. The signal on line 44 actuates gate 54 to an open condition so that clock 46 is disconnected from counter 50 and accordingly the supply of clock pulses to counter 50 is terminated. The CLI signal is also applied to control 70 to signify that the system is ready to fire a plug.

When control 70 issues an EOD signal to line 98, the signal on line 98 causes control 86 to supply clock pulses to counter 82. At a first attained count of counter 82, a signal is developed on the line 90 that is connected to the load terminal of down-counter 60. This causes the six most significant bits of the count in counter 50 to be loaded into counter 60 via bit lines 67.

As counter 82 continues to count-up, it will reach another higher count magnitude which causes a signal to be developed on line 92. The signal on line 92 causes gates 58 and 62 to be both actuated to a closed condition so that the clock pulses from clock 48 are now applied to counters 50 and 60. When a signal is developed on line 92, the supply of clock pulses to counter 82 is temporarily disabled via line 93 that is connected to control 86 to disable control 86.

The counter 50 now counts up from its previously attained count and the counter 60 counts down from the count it received when the six most significant bits of counter 50 were loaded into counter 60. The counter 60 continues to count down or decrement until it reaches a count of all zeros. At the next clock pulse, the counter 60 will underflow to all ones. This underflow sets the flip-flop 102 via line 106 to a one that is applied to lines 100 and 104. The line 104 is connected to gates 58 and 62 and when the down-counter 60 underflows to produce a signal on line 104, the gates 58 and 62 are actuated to an open condition to terminate the application of clock pulses to counters 50 and 60. When a signal is developed on line 100, control 86 is re-enabled so that counter 82 once more counts up. When counter 82 counts up to a count that causes a signal to be developed on line 94, control 70 is actuated to cause control 70 to be loaded from counter 50. As counter 82 counts up further, a signal is developed on line 96 that is connected to the reset terminal of counter 50. This resets counter 50 to zero count.

In the operation of the system shown in FIG. 2, the amplifier in control circuit 38, which is also shown in FIG. 3 of the Neuhalfen et al patent that senses primary winding current has a non-ideal transfer function. Thus, if it is assumed that the actual current limit value should be 9 amps (point 12 of FIG. 1), the transfer function of the amplifier may be such that the current limit signal CLI will occur at 90% to 100% of the actual or desired current limit value of 9 amps. Thus, it is possible that the current limit signal will be developed at 90% of the desired current limit value or at point 13 on the waveform of FIG. 1. This creates a possible 10% error in the amount of time that a particular ignition coil should be allowed to be turned on during its next ignition cycle.

The system of FIG. 2 compensates for the above mentioned possible 10% error by increasing the sensed ramp time by a fixed percentage of the sensed ramp time. Thus, the ultimate ramp time signal that is developed for use in a closed loop dwell control will be equal to the sensed ramp time added to a fixed percentage of the sensed ramp time. The manner in which this is accomplished will now be described.

It will be appreciated that since counters 50 and 60 are supplied with constant frequency clock pulses, the digital count values attained by these counters represents or is a function of elapsed time. Let it be assumed that the desired current limit value is 9 amps (point 12 of FIG. 1) but that the transfer function of the current limit amplifier is such that the current limit signal CLI is developed at 90% (point 13 of FIG. 1) of the desired current limit value. It can be seen in FIG. 1 that the sensed ramp time has been reduced from the desired ramp time and the system of this invention compensates for this.

When transistor 30 is biased conductive at SOD the ramp counter 50 begins to count-up and it counts the clock pulses from clock 46 until the current limit signal CLI is developed which has been assumed to be at 90% of the desired current limit value. The ramp counter 50 now contains a count value that corresponds to the sensed ramp time and subsequently the six most significant bits of ramp counter 50 are loaded into the down-counter 60. This essentially performs a logical divide by eight in regard to the count in the ramp counter 50 or in other words the count in down-counter 60 will be $\frac{1}{8}$ of the count previously attained by counter 50. Therefore, since counter 50 contained 90% of the desired coil ramp time, the counter 60 contains 11.25% of the total desired ramp time ($0.9 \times \frac{1}{8} = 0.1125$). The counters 50 and 60 now begin counting at the frequency of clock 48 with counter 50 counting-up and counter 60 counting-down. This continues until counter 60 underflows in a manner previously described. The ramp counter 50 now contains the sensed ramp time (SOD to CLI), plus 11.25% of that sensed ramp time. The count so attained by ramp counter 50 can then be loaded into an anti-dwell counter in control 70 of the type disclosed in Neuhalfen et al patent in order to provide closed loop dwell control. In summary, the ultimate count that is attained by ramp counter 50 will be a count value related to sensed ramp time added to a fixed or constant percentage (11.25%) of the sensed ramp time.

In the description of this invention only one ignition coil 24 has been illustrated. The system will include additional ignition coils as disclosed in the Neuhalfen et al patent and as previously described can use latches arranged such that data collected for a given ignition coil is used to subsequently control the dwell time of this same ignition coil.

In the description of this invention, it has been pointed out that gates control the periodic application of clock pulses to counters 50 and 60. This same function could be accomplished by selectively enabling and disabling the clocks.

The reason that clock 48 has a higher frequency than clock 46 is to speed up the processing of the digital information or, in other words, reduce the time required for ramp counter 50 to attain its ultimate usable count value.

The embodiments of the invention in which an exclusive property or privilege is claimed are defined as follows:

1. The method of developing a digital signal for use in a dwell control system of an electronic internal combustion engine ignition system, the ignition system having an ignition coil including primary and secondary windings, the steps comprising, applying constant frequency clock pulses to an up-counter for a period of time beginning with energization of the primary winding of the ignition coil and ending when primary winding current increases to a sensed current limit value whereby the count magnitude attained by said counter is a function of the duration of said period of time, and then processing said count magnitude attained by said up-counter during said period of time to produce a digital signal the magnitude of which is equal to said count magnitude added to a fixed percentage of said count magnitude.

2. The method of developing a digital signal for use in a dwell control system of an electronic internal combustion engine ignition system, the ignition system having an ignition coil including primary and secondary windings, the steps comprising, applying constant frequency clock pulses to an up-counter for a period of time beginning with energization of the primary winding of the ignition coil and ending when primary winding current increases to a sensed current limit value whereby the count magnitude attained by said counter is a function of the duration of said period of time, loading a down-counter with a count magnitude that is equal to the count magnitude attained by said up-counter during said period of time divided by a predetermined constant factor and then causing said up-counter to count-up and said down counter to count-down at a constant frequency until the count in said down-counter is counted down to zero.

3. A control circuit for developing a digital electrical signal for use in a dwell control system of an electronic internal combustion engine ignition system comprising, an ignition coil having primary and secondary windings, transistor switching means connected in series with said primary winding, means for biasing said transistor switching means periodically conductive and nonconductive, current sensing means connected to said primary winding for sensing primary winding current, means coupled to said current sensing means for developing a current limit signal and for causing said transistor switching means to operate in a current limit mode when primary winding current attains a current limit magnitude, an up-counter, a source of constant frequency clock pulses, means for causing said clock pulses to be applied to said counter for a period of time beginning when said transistor switching means is biased conductive and ending when said current limit signal is developed whereby said counter attains a count magnitude that is related to the duration of said period of time and means for processing said count magnitude to obtain a digital signal the magnitude of which is equal to said count magnitude added to a fixed percentage of said count magnitude.

4. The control circuit according to claim 3 where said up-counter is a multi-bit counter and where said processing means comprises a multi-bit down-counter that is adapted to be loaded with the most significant bits of the count attained by said up-counter during said period of time.

5. A control system for providing a digital signal for use in a dwell control system of an electronic internal combustion engine ignition system that includes an ignition coil having primary and secondary windings comprising, a multi-bit up-counter, a multi-bit down-counter, said system comprising means for causing said up-counter to count up at a constant frequency for a time period beginning with energization of said primary winding and ending when primary winding current attains a current limit value, means operative to load the most significant bits of the count attained by said up-counter during said time period into said down-counter when said primary winding current attains said current limit value whereby said down-counter is loaded with a count magnitude that is a divided representation of the count attained by said up-counter, means operative after said down-counter has been loaded for causing said up-counter to count up and for causing said down-counter to count down at a constant frequency and means for causing the up-counting of said up-counter and the down counting of said down-counter to terminate when the count in said down-counter is counted down to zero.

6. The control system according to claim 5 where the system has first and second clock pulse sources, the frequency of the second clock pulse source being higher than the frequency of the first clock pulse source and wherein said up-counter is up-counted by said first clock pulse source during said time period and wherein said up-counting of said up-counter and simultaneous down-counting of said down-counter is by said second clock pulse source.

* * * * *